US010019951B2

(12) United States Patent
Nakajima et al.

(10) Patent No.: US 10,019,951 B2
(45) Date of Patent: Jul. 10, 2018

(54) DISPLAY APPARATUS AND METHOD FOR DRIVING DISPLAY APPARATUS

(71) Applicant: JVC KENWOOD Corporation, Yokohama-shi, Kanagawa (JP)

(72) Inventors: Nobuki Nakajima, Yokohama (JP); Takatsugu Aizaki, Yokohama (JP)

(73) Assignee: JVC KENWOOD Corporation, Yokohama-shi (JP)

( * ) Notice: Subject to any disclaimer, the term of this patent is extended or adjusted under 35 U.S.C. 154(b) by 0 days.

(21) Appl. No.: 15/137,192

(22) Filed: Apr. 25, 2016

(65) Prior Publication Data

US 2016/0322003 A1 Nov. 3, 2016

(30) Foreign Application Priority Data

May 1, 2015 (JP) ..... 2015-094024

(51) Int. Cl.
*G09G 3/34* (2006.01)
*G09G 3/20* (2006.01)
*G09G 3/36* (2006.01)

(52) U.S. Cl.
CPC ..... *G09G 3/3406* (2013.01); *G09G 3/2025* (2013.01); *G09G 3/3611* (2013.01); *G09G 2320/0252* (2013.01)

(58) Field of Classification Search
CPC ..... G09G 2310/027; G09G 2310/0272; G09G 2310/0275; G09G 2310/0278; G09G 2310/0297; G09G 3/20; G09G 3/2003; G09G 3/2007; G09G 3/2011; G09G 3/2014; G09G 3/2018; G09G 3/2022; G09G 3/2025; G09G 3/2029; G09G 3/3406; G09G 3/3611; G09G 2320/0252
USPC ..... 345/690
See application file for complete search history.

(56) References Cited

U.S. PATENT DOCUMENTS 6,130,731 A * 10/2000 Andersson ..... G02F 1/13471 349/100
6,232,963 B1 * 5/2001 Tew ..... G09G 3/3406 345/102
6,771,243 B2 * 8/2004 Hirohata ..... G09G 3/20 345/690
8,228,350 B2 * 7/2012 Ng ..... G09G 3/3406 345/214
9,024,964 B2 * 5/2015 Ng ..... G09G 3/2055 345/596
9,210,389 B2 * 12/2015 Fukutomi ..... H04N 9/3155
2002/0093480 A1 * 7/2002 Mizutani ..... G09G 3/3406 345/102

(Continued)

FOREIGN PATENT DOCUMENTS

JP 2013-168834 8/2013

*Primary Examiner* — Grant Sitta
(74) *Attorney, Agent, or Firm* — Amin, Turocy & Watson LLP

(57) ABSTRACT

In a display element, each pixel is controlled to an ON state and OFF state in accordance with a video signal. Each pixel of the display element is controlled to an OFF state in a first period shorter than a predetermined frame period, the first period including at least one of a front end and a rear end of the frame period of the video signal. In addition, light emission of a light source that emits light on the display element is stopped in a second period including the first period.

4 Claims, 15 Drawing Sheets

(56) References Cited

U.S. PATENT DOCUMENTS

| | | | | |
|---|---|---|---|---|
| 2002/0135553 | A1* | 9/2002 | Nagai | G09G 3/34 345/89 |
| 2005/0248592 | A1* | 11/2005 | Feng | G09G 3/3426 345/690 |
| 2006/0146005 | A1* | 7/2006 | Baba | G09G 3/3233 345/102 |
| 2007/0085817 | A1* | 4/2007 | Chen | G09G 3/3648 345/102 |
| 2008/0180385 | A1* | 7/2008 | Yoshida | G09G 3/20 345/102 |
| 2012/0162289 | A1* | 6/2012 | Oniki | G09G 3/342 345/690 |

* cited by examiner

FIG.4

| SF / GRADA-TION | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| 0 | 0 | 0 | 0 | 0 | 0 | 0 | 0 | 0 | 0 | 0 | 0 | 0 |
| 1 | 1 | 0 | 0 | 0 | 0 | 0 | 0 | 0 | 0 | 0 | 0 | 0 |
| 2 | 1 | 1 | 0 | 0 | 0 | 0 | 0 | 0 | 0 | 0 | 0 | 0 |
| 3 | 1 | 1 | 1 | 0 | 0 | 0 | 0 | 0 | 0 | 0 | 0 | 0 |
| 4 | 1 | 1 | 1 | 1 | 0 | 0 | 0 | 0 | 0 | 0 | 0 | 0 |
| 5 | 1 | 1 | 1 | 1 | 1 | 0 | 0 | 0 | 0 | 0 | 0 | 0 |
| 6 | 1 | 1 | 1 | 1 | 1 | 1 | 0 | 0 | 0 | 0 | 0 | 0 |
| 7 | 1 | 1 | 1 | 1 | 1 | 1 | 1 | 0 | 0 | 0 | 0 | 0 |
| 8 | 1 | 1 | 1 | 1 | 1 | 1 | 1 | 1 | 0 | 0 | 0 | 0 |
| 9 | 1 | 1 | 1 | 1 | 1 | 1 | 1 | 1 | 1 | 0 | 0 | 0 |
| 10 | 1 | 1 | 1 | 1 | 1 | 1 | 1 | 1 | 1 | 1 | 0 | 0 |
| 11 | 1 | 1 | 1 | 1 | 1 | 1 | 1 | 1 | 1 | 1 | 1 | 0 |
| 12 | 1 | 1 | 1 | 1 | 1 | 1 | 1 | 1 | 1 | 1 | 1 | 1 |

FIG.6

| SF / GRADA-TION | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| 0 | 0 | 0 | 0 | 0 | 0 | 0 | 0 | 0 | 0 | 0 | 0 | 0 |
| 1 | 1 | 0 | 0 | 0 | 0 | 0 | 0 | 0 | 0 | 0 | 0 | 0 |
| 2 | 1 | 1 | 0 | 0 | 0 | 0 | 0 | 0 | 0 | 0 | 0 | 0 |
| 3 | 1 | 1 | 1 | 0 | 0 | 0 | 0 | 0 | 0 | 0 | 0 | 0 |
| 4 | 1 | 1 | 1 | 1 | 0 | 0 | 0 | 0 | 0 | 0 | 0 | 0 |
| 5 | 1 | 1 | 1 | 1 | 1 | 0 | 0 | 0 | 0 | 0 | 0 | 0 |
| 6 | 1 | 1 | 1 | 1 | 1 | 1 | 0 | 0 | 0 | 0 | 0 | 0 |
| 7 | 1 | 1 | 1 | 1 | 1 | 1 | 1 | 0 | 0 | 0 | 0 | 0 |
| 8 | 1 | 1 | 1 | 1 | 1 | 1 | 1 | 1 | 0 | 0 | 0 | 0 |
| 9 | 1 | 1 | 1 | 1 | 1 | 1 | 1 | 1 | 1 | 0 | 0 | 0 |

FIG.7A x y

| | $x_0$ | $x_1$ | $x_2$ | $x_3$ | $x_4$ |
|---|---|---|---|---|---|
| $y_0$ | 3 | 1 | 0 | 5 | 12 |
| $y_1$ | 1 | 2 | 4 | 6 | 10 |
| $y_2$ | 1 | 2 | 5 | 6 | 10 |
| $y_3$ | 2 | 3 | 8 | 5 | 9 |
| $y_4$ | 2 | 4 | 9 | 4 | 8 |

FIG.7B x y

| | $x_0$ | $x_1$ | $x_2$ | $x_3$ | $x_4$ |
|---|---|---|---|---|---|
| $y_0$ | 3 | 1 | 0 | 5 | 9 |
| $y_1$ | 1 | 2 | 4 | 6 | 9 |
| $y_2$ | 1 | 2 | 5 | 6 | 9 |
| $y_3$ | 2 | 3 | 8 | 5 | 9 |
| $y_4$ | 2 | 4 | 9 | 4 | 8 |

FIG.16

| SF / GRADATION | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| 0 | 0 | 0 | 0 | 0 | 0 | 0 | 0 | 0 | 0 | 0 | 0 | 0 |
| 1 | 0 | 0 | 0 | 0 | 0 | 0 | 0 | 0 | 0 | 0 | 0 | 1 |
| 2 | 0 | 0 | 0 | 0 | 0 | 0 | 0 | 0 | 0 | 0 | 1 | 1 |
| 3 | 0 | 0 | 0 | 0 | 0 | 0 | 0 | 0 | 0 | 1 | 1 | 1 |
| 4 | 0 | 0 | 0 | 0 | 0 | 0 | 0 | 0 | 1 | 1 | 1 | 1 |
| 5 | 0 | 0 | 0 | 0 | 0 | 0 | 0 | 1 | 1 | 1 | 1 | 1 |
| 6 | 0 | 0 | 0 | 0 | 0 | 0 | 1 | 1 | 1 | 1 | 1 | 1 |
| 7 | 0 | 0 | 0 | 0 | 0 | 1 | 1 | 1 | 1 | 1 | 1 | 1 |
| 8 | 0 | 0 | 0 | 0 | 1 | 1 | 1 | 1 | 1 | 1 | 1 | 1 |
| 9 | 0 | 0 | 0 | 1 | 1 | 1 | 1 | 1 | 1 | 1 | 1 | 1 |

DISPLAY APPARATUS AND METHOD FOR DRIVING DISPLAY APPARATUS

CROSS-REFERENCE TO RELATED APPLICATION(S)

The present application claims priority to and incorporates by reference the entire contents of Japanese Patent Application No. 2015-094024 filed in Japan on May 1, 2015.

BACKGROUND OF THE INVENTION

Field of the Invention

The present invention relates to a display apparatus and a method for driving the display apparatus.

Description of the Related Art

A display apparatus using a liquid crystal display element has an insufficient response speed of a liquid crystal for displaying a moving image and an unsatisfactory display quality of a moving image. Conventionally, therefore, moving image performance has been enhanced through insertion of a black display period in which black is displayed in each frame of a video signal with transmittance of a liquid crystal of approximately 0%. In addition, Japanese Laid-open Patent Publication No. 2013-168834 discloses a technique for further improving moving image performance in a projection apparatus using a liquid crystal display element, by inserting a black display period into a video signal and by controlling a diaphragm mechanism to be fully closed in the black display period in order to further improve display quality of a moving image.

However, there is a problem that a certain delay time (for example, several milliseconds) exists for a transition to the black display period, for example, for a transition of liquid crystal transmittance from a state of approximately 100% to a state of approximately 0% due to characteristics of a liquid crystal, and that a sufficient effect of insertion of the black display period is not obtained. Therefore, it is difficult to sufficiently improve display quality of a moving image through insertion of the black display period into a video signal.

In addition, since the diaphragm mechanism is fully closed in the black display period according to the technique of Japanese Laid-open Patent Publication No. 2013-168834, improvement in display quality of a moving image is expected. However, Japanese Laid-open Patent Publication No. 2013-168834 needs to open and close the diaphragm mechanism on a frame-by-frame basis, which could complicate control.

SUMMARY OF THE INVENTION

It is an object of the present invention to at least partially solve the problems in the conventional technology.

According to one embodiment of the present invention, there is provided a display apparatus comprising: a liquid crystal display control unit configured to control each of pixels of a display element in which each of the pixels is controlled to ON and OFF in accordance with a video signal to OFF in a predetermined first period including at least one of a front end and a rear end of a frame period of the video signal; and a light source control unit configured to stop light emission of a light source that emits light on the display element in a second period including the first period, wherein the first period is shorter than the frame period.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 4 is a diagram illustrating an example of a digital drive pattern according to an existing technique;

FIG. 6 is a diagram illustrating an example of the digital drive pattern with a black display period inserted according to the first embodiment;

FIGS. 7A and 7B are diagrams illustrating examples of each pixel of a display element;

FIG. 16 is a diagram illustrating an example of a drive gradation table applicable to the second embodiment.

DETAILED DESCRIPTION OF THE PREFERRED EMBODIMENTS

Preferred embodiments of a display apparatus and a method for driving the display apparatus will be described in detail below with reference to the accompanying drawings. Specific numerical values, external appearance and structure, and the like illustrated in such embodiments are merely illustrative for facilitating understanding of the present invention, and do not limit the present invention unless otherwise specified. It is to be noted that elements having no direct relation with the present invention omit detailed description and illustration.

Figure 1:
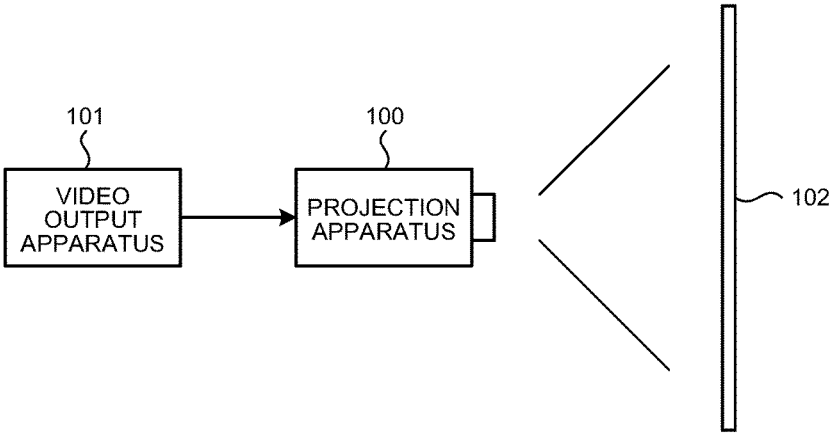
FIG. 1 is a diagram illustrating a configuration of an example of a display system applicable to each embodiment.

FIG. 1 is a diagram illustrating a configuration of an example of a display system applicable to each embodiment.

In FIG. 1, a projection apparatus 100 as a display apparatus includes a light source and a display element. The projection apparatus 100 modulates light emitted from the light source by using the display element in accordance with a video signal supplied from a video output apparatus 101, and emits the light as projection light according to the video signal. The projection light emitted from the projection apparatus 100 is projected on a projection target medium 102, such as a screen, and is displayed on the projection target medium 102 as a projection video according to the video signal.

First Embodiment

Figure 2:
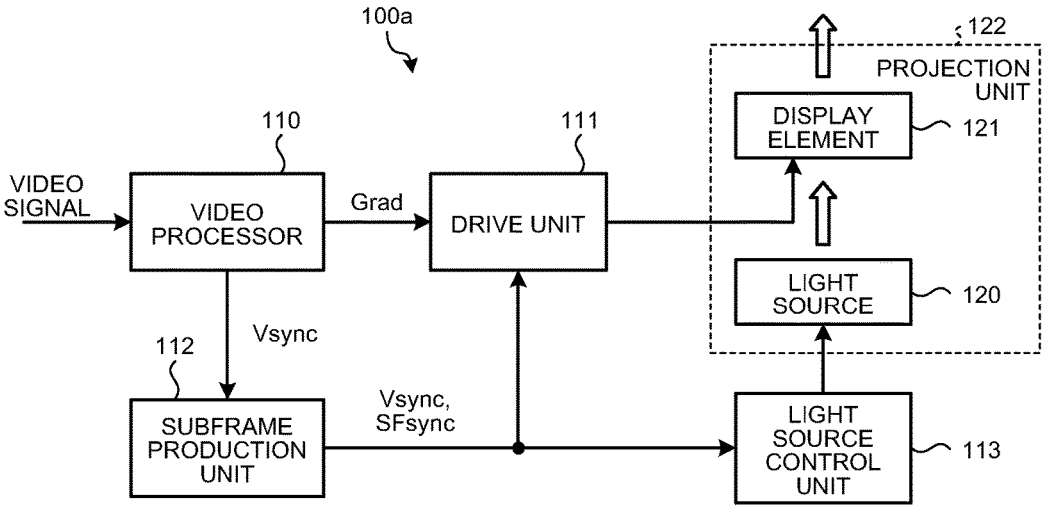
FIG. 2 is a block diagram schematically illustrating a configuration of an example of a projection apparatus according to a first embodiment.

The projection apparatus according to a first embodiment will be described. FIG. 2 schematically illustrates a configuration of an example of the projection apparatus according to the first embodiment. In FIG. 2, a projection apparatus 100*a* corresponding to the projection apparatus 100 of FIG. 1 includes a video processor 110, a drive unit 111, a subframe production unit 112, a light source control unit 113, and a projection unit 122. In addition, the projection unit 122 includes a light source 120 and a display element 121.

A video signal is input into the video processor 110. Here, the video signal is a digital video signal for displaying a moving image with a frame image updated in a predetermined frame cycle (for example, 60 frames per second). The video signal is not limited to this example, and for example, the video processor 110 may convert an analog video signal into a digital video signal. For purposes of description, the video signal can represent 13-level gradation from a gradation value "0" to gradation value "12" for each of the pixels. Here, the gradation value "0" and gradation value "12" correspond to black display and white display, respectively, and the gradation value "1" through gradation value "11" correspond to halftone display of brightness according to the gradation value.

The video processor 110 extracts a frame synchronization signal Vsync indicating a front of a frame, and gradation information Grad of each pixel from the input video signal. The gradation information Grad includes the gradation value (luminance value) of a pixel. The video processor 110 supplies the extracted gradation information Grad to the drive unit 111. In addition, the video processor 110 supplies the extracted frame synchronization signal Vsync to the subframe production unit 112.

The subframe production unit 112 is a divided period production unit that produces divided periods obtained through equal division of a one-frame period in accordance with the frame synchronization signal Vsync supplied from the video processor 110. These divided periods are hereinafter referred to as subframes. In this example, the subframe production unit 112 equally divides the one-frame period, for example, by using a number of divisions of 12 to produce 12 subframes from SF1, SF2, . . . , SF12.

The subframe production unit 112 generates, for example, a subframe synchronization signal SFsync that indicates timing of the divided each subframe SF1, SF2, . . . , SF12, and then outputs the generated subframe synchronization signal SFsync together with the frame synchronization signal Vsync. The frame synchronization signal Vsync and subframe synchronization signal SFsync that are output from the subframe production unit 112 are supplied to each of the drive unit 111 and the light source control unit 113.

The light source control unit 113 generates a light source control signal for controlling light emission of the light source 120 based on the frame synchronization signal Vsync and subframe synchronization signal SFsync supplied from the subframe production unit 112. The light source 120 is, for example, a semiconductor laser, and at least light emission and stop of light emission of a laser beam is controlled in accordance with the light source control signal supplied from the light source control unit 113. In addition, light emission timing of the light source 120 is controllable at least on an aforementioned subframe basis in accordance with the light source control signal.

It is to be noted that the light source 120 may be a light source of another type as long as light emission timing is controllable on a subframe basis and a response speed is high. For example, an LED (Light Emitting Diode) may be used as the light source.

Meanwhile, the drive unit 111 generates a driving signal for driving the display element 121 in accordance with the gradation information Grad for each pixel supplied from the video processor 110, and the frame synchronization signal Vsync and subframe synchronization signal SFsync supplied from the subframe production unit 112. The driving signal is supplied to the display element 121.

The display element 121 includes pixels arranged in a matrix, and modulates and emits light incident from the light source 120 for each pixel in accordance with the driving signal supplied from the drive unit 111, based on the video signal. According to the first embodiment, a liquid crystal display element using characteristics of a liquid crystal is used as the display element 121. The liquid crystal display element includes a liquid crystal inserted between a pixel electrode for each pixel and a common electrode common to respective pixels. The liquid crystal display element displays a video by changing transmittance of the liquid crystal to light of a specific polarization direction, through application of a voltage to each pixel according to the video signal by the pixel electrode.

According to the first embodiment, a reflective liquid crystal display element is used as the display element 121. In the reflective liquid crystal display element, light emitted on an incident plane travels through a liquid crystal layer from the incident plane, is emitted on a reflection plane, is reflected by the reflection plane, travels through the liquid crystal layer again, and is emitted from the incident plane to outside. In order to change a polarization state of the incident light for emission, polarization separation of the incident light and emitted light are performed by using a polarization beam splitter and the like by the reflective liquid crystal display element.

Next, control according to the first embodiment will be more specifically described. According to the first embodiment, the drive unit 111 drives the display element 121 under a digital drive scheme to control display made by the display element 121. That is, the drive unit 111 functions as a liquid crystal display control unit that controls display made by the display element 121 using a liquid crystal. Under the digital drive scheme according to the first embodiment, the drive unit 111 controls each pixel in two states, an ON state and an OFF state. Here, the ON state is, for example, a state where transmittance of a liquid crystal is highest, and is a state where incidence of white light to a liquid crystal produces display of approximate white (white display). Meanwhile, the OFF state is, for example, a state where transmittance of a liquid crystal is lowest, and is a state where incidence of white light to a liquid crystal produces display of approximate black (black display). In addition, for a certain pixel, among subframes within a one-frame period, the drive unit 111 selects the number of continuous subframes according to a gradation value of the pixel from a front end or rear end of the one-frame period, controls the pixel to an ON state in the selected subframes, and controls the pixel to an OFF state in other subframes. Thus, the drive unit 111 represents gradation in the pixel.

The first embodiment controls light emission and stop of light emission of the light source 120 within the one-frame period. At this time, in a predetermined period including either one of the front end and rear end of the one-frame period, the drive unit 111 causes the light source 120 to stop light emission, and the drive unit 111 causes the light source 120 to emit light in a period other than the predetermined period. In this way, providing a period in which light emission of the light source 120 is stopped in the front end or rear end of the one-frame period makes it possible to mask a non-black display state caused by a delay in response of the liquid crystal when the liquid crystal transitions to a black display state.

Figure 3:
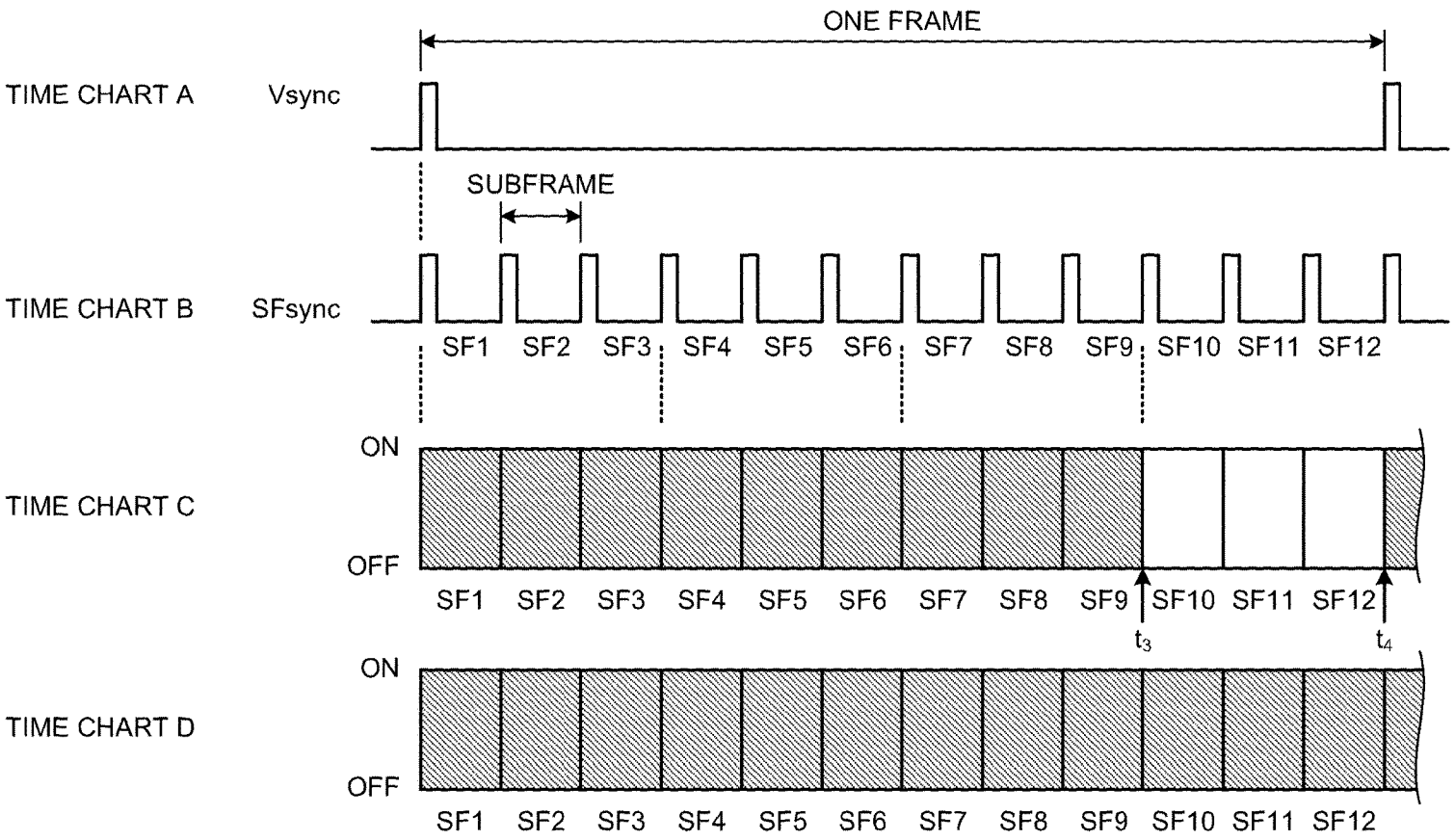
FIG. 3 is a time chart for describing light source control according to the first embodiment.

Light source control according to the first embodiment will be more specifically described with reference to a time chart of FIG. 3. In FIG. 3, time passes rightward. TIME CHART A in FIG. 3 illustrates an example of the frame synchronization signal Vsync that represents the frame period. A period from a rising edge to a next rising edge of the signal is defined as the one-frame period.

TIME CHART B in FIG. 3 illustrates an example of the subframe synchronization signal SFsync that represents a subframe period. In a similar manner to the frame synchronization signal Vsync, a period from a rising edge to a next rising edge of the subframe synchronization signal SFsync is defined as a one-subframe period. In the example of TIME CHART B in FIG. 3, the one-frame period is equally divided into 12 subframes SF1 to SF12.

TIME CHART D in FIG. 3 illustrates an example of light emission control of the light source 120 according to an existing technique. According to the existing technique, the light source 120 emits light (ON) in all the subframes SF1 to SF12, as illustrated by hatching in TIME CHART D in FIG. 3.

Here, the digital drive scheme applicable to the first embodiment will be schematically described. FIG. 4 illustrates an example of a digital drive pattern according to the existing technique. FIG. 4 illustrates the example of a relationship among the gradation values, subframes, and on/off control of pixels. In FIG. 4, each column is the subframe SF1, SF2, . . . , SF12 from left to right. Among these subframes, the subframe SF1 is a front subframe of the frame period, and the subframe SF12 is a rear-end subframe of the frame period. In addition, in FIG. 4, the gradation value increases by 1 from 0 in each row from top to bottom. The gradation value "0" is the lowest (darkest) gradation, and the gradation value "12" is the highest (brightest) gradation.

The drive unit 111 selects the consecutive subframes the number of which depends on the gradation value of the pixel from the front end of the frame period, and controls the pixel to an ON state in the selected subframes. In FIG. 4, a cell with a value "1" illustrated by hatching represents that the pixel is controlled to an ON state, while a cell with a value "0" represents that the pixel is controlled to an OFF state.

For example, when the gradation value of a certain pixel is "3", the drive unit 111 selects three subframes from the front subframe SF1 of the frame period (subframes SF1, SF2, and SF3). The drive unit 111 then controls the pixel to an ON state in the selected subframes. Meanwhile, the drive unit 111 controls the pixel to an OFF state in other nine subframes (subframes SF4 to SF12).

For example, when the gradation value of a certain pixel is "12", the drive unit 111 selects 12 subframes from the front subframe SF1 of the frame period (subframes SF1 to SF12). The drive unit 111 then controls the pixel to an ON state in the selected subframes. In this case, there exists no subframe to be controlled to an OFF state. Furthermore, for example, when the gradation value of a certain pixel is "0", the drive unit 111 controls the pixel to an OFF state in all the subframes (subframes SF1 to SF12) within the one-frame period. In this case, there exists no subframe to be controlled to an ON state.

Thus, according to the existing technique, the subframes to undergo ON control and OFF control are allocated in advance for each gradation.

Figure 5:
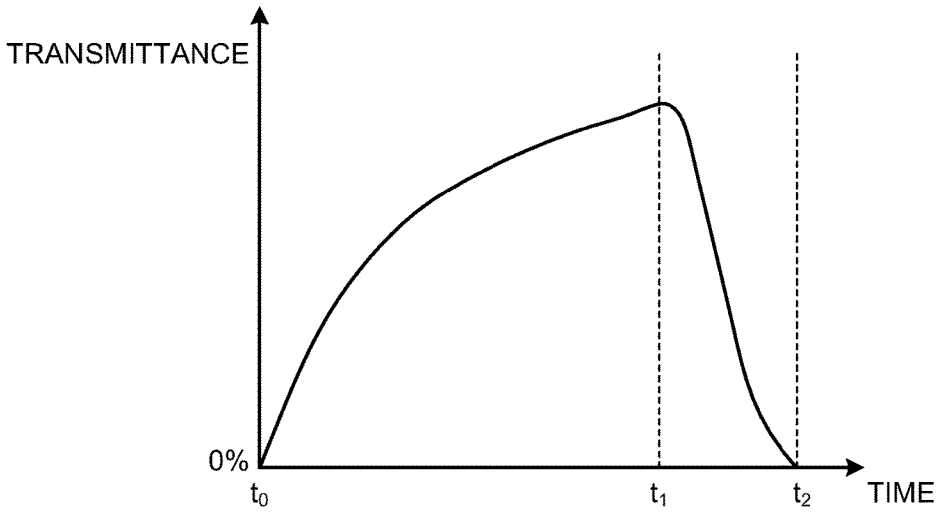
FIG. 5 is a diagram for describing characteristics of a liquid crystal.

Next, the digital drive scheme according to the first embodiment will be described. First, characteristics of a liquid crystal will be described with reference to FIG. 5. In FIG. 5, a vertical axis represents transmittance of a liquid crystal, and a horizontal axis represents time. For example, in the display element 121, a voltage for controlling a liquid crystal to an ON state is applied to the pixel electrode of the pixel in an OFF state at time $t_0$. In response to control of the liquid crystal to an ON state, transmittance of the liquid crystal increases and becomes, for example, saturated at time $t_1$, and the liquid crystal becomes in an ON state.

Furthermore, at time $t_1$ when the liquid crystal becomes in an ON state, for example, application of the voltage to the pixel electrode is stopped to control the liquid crystal to an OFF state. In this case, transmittance of the liquid crystal becomes approximately 0% at time $t_2$ when predetermined time elapses from time $t_1$.

For example, consider a case where a period from time $t_0$ to time $t_2$ is the one-frame period, and where the liquid crystal is controlled so that transmittance becomes saturated at time $t_1$. In this case, a period from time $t_1$ to time $t_2$ during which transmittance decreases from the saturation state to approximately 0% (referred to as a black transition period) is typically several milliseconds. Meanwhile, when the video signal is, for example, 60 frames/sec, the one-frame period is 1/60 seconds, that is, approximately 16.7 msec. For example, when the black transition period is 2 msec, the black transition period will account for 12% of the one-frame period, which could degrade display quality of a moving image.

Therefore, in a period including this black transition period, the first embodiment performs black display insertion for controlling all the pixels to an OFF state, and stops light emission of the light source 120. A stop of light emission of the light source 120 provides black display in a state where an influence of the characteristics of a liquid crystal is inhibited, which improves display quality of a moving image. Here, as the light source 120, it is preferable to select a light source with response time at least shorter than the black transition period of a liquid crystal.

Returning to FIG. 3, TIME CHART C in FIG. 3 illustrates an example of light emission control of the light source 120 according to the first embodiment. According to the first embodiment, the light source control unit 113 causes the light source 120 to stop light emission in a predetermined period including the rear end of the frame period (OFF), and causes the light source 120 to emit light in the other period of the frame period (ON). The period for stopping light emission of the light source 120 is a period including the aforementioned black transition period.

In the example of TIME CHART C in FIG. 3, for the light source control unit 113, the period from time $t_3$ at the front end of the subframe SF10 to time $t_4$ at the rear end of the subframe SF12 is a period including the aforementioned black transition period, that is, the period from time $t_1$ to time $t_2$ in FIG. 5. Accordingly, the light source control unit 113 causes the light source 120 to stop light emission in these subframes SF10 to SF12.

According to the first embodiment, furthermore, the digital drive pattern is a pattern in which the black display period is inserted. FIG. 6 illustrates an example of the digital drive pattern with the black display period inserted according to the first embodiment. According to the first embodiment, for example, as described above, light emission of the light source 120 is stopped in three subframes SF10 to SF12 among the 12 subframes SF1 to SF12. Accordingly, control of the gradation values "10" to "12" using the subframes SF10 to SF12 illustrated in FIG. 4 does not make sense.

Therefore, according to the first embodiment, as illustrated in FIG. 6, drivable gradation includes 10-level gradation of the gradation values "0" to "9", and gradation is represented using nine subframes SF1 to SF9. In addition, the video signal changes the gradation value equal to or greater than the gradation value "10" to the gradation value "9".

In other words, according to the first embodiment, the one-frame period is divided into the subframes SF1 to SF12 including the black transition period, and the subframes SF1 to SF9 that do not include the black transition period are set as a gradation representation period to which the gradation values are allocated.

Control of the projection unit 122 according to the first embodiment will be more specifically described with reference to FIGS. 7A and 7B and FIG. 8. FIGS. 7A and 7B each illustrate an example of each pixel of the display element 121. For description here, FIGS. 7A and 7B illustrate the display element 121 including five pixels by five pixels, and illustrate each pixel in coordinates $(x_n, y_n)$. A numerical value within each cell of FIGS. 7A and 7B illustrates an example of the gradation value of each pixel according to the video signal.

It is assumed here that the video signal in which each pixel has the gradation value illustrated in FIG. 7A is input into the video processor 110. In the example of FIG. 7A, the gradation values of pixels $(x_4, y_0)$, $(x_4, y_1)$, and $(x_4, y_2)$ are "12", "10", and "10", respectively, which exceed a drivable upper limit gradation value "9". Therefore, the video processor 110 changes the gradation value of each pixel that exceeds the drivable upper limit gradation value "9" into the gradation value "9", as illustrated by hatching in FIG. 7B.

Human visual characteristics have a tendency to have difficulty in recognizing a change in a bright image (image with a great gradation value) as compared with a change in a dark image (image with a small gradation value). Therefore, as described above, even if the gradation value of the pixel having the gradation value that exceeds the drivable upper limit gradation value is changed to this upper limit gradation value, this is unlikely to be a factor in significant degradation of display quality.

Figure 8:
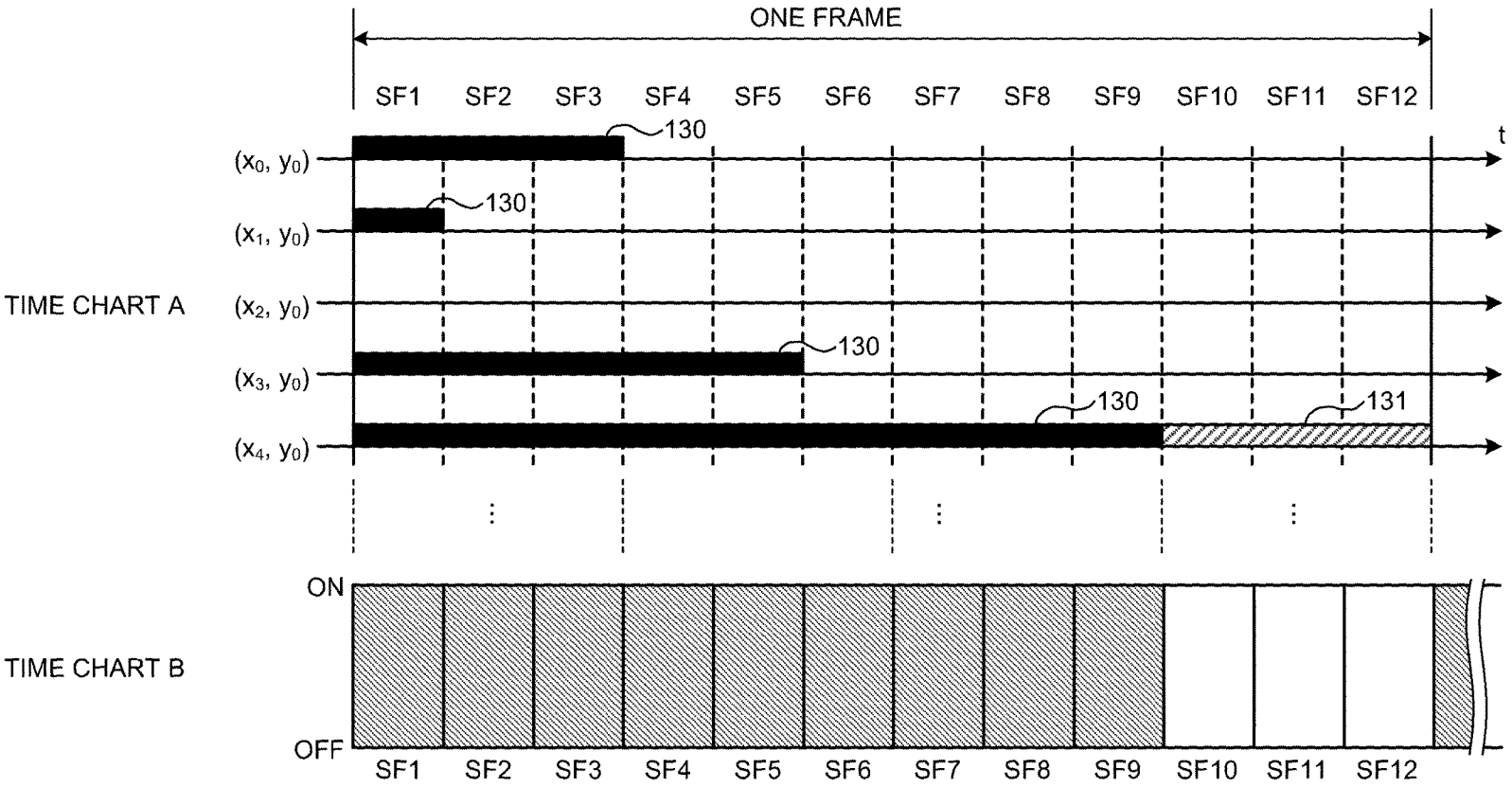
FIG. 8 is a diagram illustrating an example of a relationship between on/off control of each pixel in the display element and light emission control of a light source according to the first embodiment.

FIG. 8 illustrates an example of a relationship between on/off control of each pixel in the display element 121 and light emission control of the light source 120 according to the first embodiment. In FIG. 8, time passes rightward.

TIME CHART A in FIG. 8 illustrates ON sections 130 in which five pixels $(x_0, y_0)$ to $(x_4, y_0)$ are controlled to an ON state in the example of FIG. 7B. Here, in each pixel, as illustrated in FIG. 7B, the gradation value exceeding the drivable upper limit gradation value is changed to the upper limit gradation value.

With reference to FIG. 7B, the drive unit 111 sets the subframes SF1 to SF3 to an ON section 130 for the gradation value of "3" of pixel $(x_0, y_0)$, and the drive unit 111 sets only the subframe SF1 to an ON section 130 for the gradation value of "1" of pixel $(x_1, y_0)$. Since the gradation value of pixel $(x_2, y_0)$ is "0", the drive unit 111 does not provide an ON section 130. Since the gradation value of pixel $(x_3, y_0)$ is "5", the drive unit 111 sets the subframes SF1 to SF5 to an ON section 130.

In addition, since the changed gradation value of pixel $(x_4, y_0)$ is "9", the drive unit 111 sets the subframes SF1 to SF9 to an ON section 130.

TIME CHART B in FIG. 8 illustrates an example of light quantity control of the light source 120. In this example, in a similar manner to TIME CHART C in FIG. 3, the light source control unit 113 controls the light source 120 to stop light emission (OFF) in a predetermined period (subframes SF10 to SF12) including the rear end of the one-frame period, and the light source control unit 113 controls the light source 120 to emit light (ON) in the other period (subframes SF1 to SF9). Therefore, for example, a section 131 is masked including the black transition period when control of pixel $(x_4, y_0)$ having the gradation value of "9" is switched from an ON state to an OFF state with transition from the subframe SF9 to the subframe SF10, black display is obtained more securely in the black transition period, and display quality of a moving image can be improved.

Although light emission of the light source 120 is stopped in the predetermined period including the rear end of the one-frame period in the above case, the predetermined period is not limited to this example. That is, the predetermined period for stopping light emission of the light source 120 may include at least one of the front end and rear end of the one-frame period.

Second Embodiment

Figure 9:
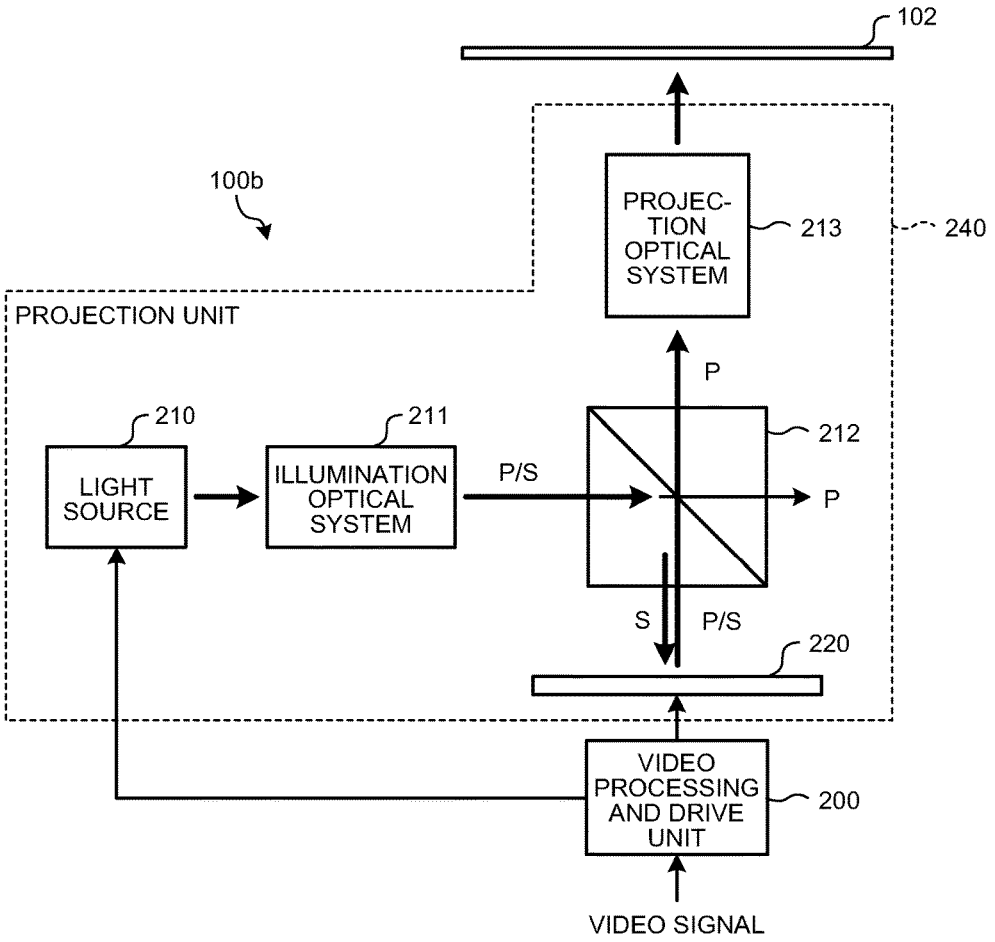
FIG. 9 is a block diagram illustrating a configuration of an example of a projection apparatus according to a second embodiment.

Next, a second embodiment will be described. FIG. 9 illustrates a configuration of an example of a projection apparatus 100*b* according to the second embodiment, corresponding to the projection apparatus 100 of FIG. 1. The projection apparatus 100*b* includes a video processing and drive unit 200 and a projection unit 240. The projection unit 240 includes a light source 210, an illumination optical system 211, a polarization separator 212, a projection optical system 213, and a display element 220.

The video processing and drive unit 200 generates, for example, a light source control signal for controlling the light source 210, and a driving signal for driving the display element 220 based on a video signal supplied from a video output apparatus 101.

The light source 210 corresponds to the light source 120 of FIG. 2, and for example, a semiconductor laser is used. Light emitted from the light source 210 travels through the illumination optical system 211, and is incident in the optical isolator 212. The light incident in the optical isolator 212 from the illumination optical system 211 is light including P-polarized light and S-polarized light.

The polarization separator 212 includes a polarization separating plane for separating the P-polarized light and the S-polarized light included in the light, and the polarization separating plane transmits the P-polarized light and reflects the S-polarized light. As the polarization separator 212, a polarizing beam splitter can be used. The light incident in the polarization separator 212 from the illumination optical system 211 is separated into the P-polarized light and the S-polarized light by the polarization separating plane. The P-polarized light passes through the polarization separating plane, and the S-polarized light is reflected by the polarization separating plane, and is emitted on the display element 220.

Figure 10:
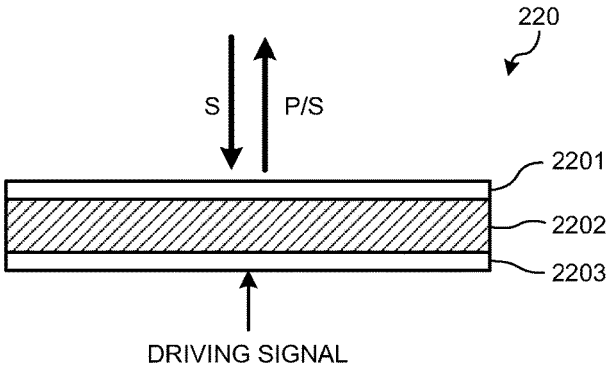
FIG. 10 is a diagram illustrating an example of a configuration of the display element in a cross section of a direction parallel to an incident direction of light.

The display element 220 corresponds to the display element 121 of FIG. 2, and for example, the display element 220 is a reflective liquid crystal display element. FIG. 10 illustrates an example of a configuration of the display element 220 in a cross section of a direction parallel to an incident direction of light. The display element 220 includes a counter electrode 2201, a pixel electrode unit 2203 including a pixel electrode and a pixel circuit that drives the pixel electrode, and a liquid crystal layer 2202. The display element 220 is constructed to have the liquid crystal layer 2202 inserted between the counter electrode 2201 and the pixel electrode of the pixel electrode unit 2203. In the display element 220, a voltage is applied to the liquid crystal layer 2202 between the pixel electrode and the opposite electrode 2201 in response to the driving signal supplied to the pixel circuit.

The S-polarized light incident on the display element 220 travels through the counter electrode 2201 and the liquid crystal layer 2202, and is incident on the pixel electrode unit 2203. The S-polarized light is then reflected by the pixel electrode unit 2203, travels through the liquid crystal layer 2202 and the counter electrode 2201 again, and is emitted from the display element 220. At this time, the liquid crystal layer 2202 modulates the S-polarized light that is incident and reflected in accordance with the voltage applied between the counter electrode 2201 and the pixel electrode of the pixel electrode unit 2203 in response to the driving signal. The S-polarized light incident on the counter electrode 2201 is modulated during a process of reflection by the pixel electrode unit 2203 and emission from the counter electrode 2201. The S-polarized light is then emitted from the counter electrode 2201 as light including the P-polarized light and the S-polarized light.

Figure 11:
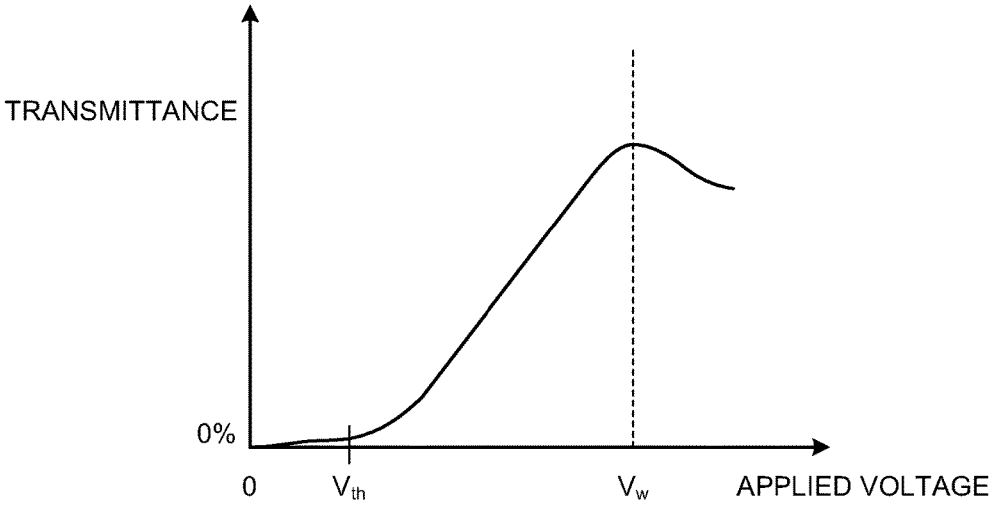
FIG. 11 is a diagram illustrating an example of characteristics of the display element.

FIG. 11 illustrates an example of characteristics of the display element 220. In FIG. 11, a horizontal axis represents an applied voltage applied to the liquid crystal layer 2202 by the pixel electrode and the counter electrode 2201. A vertical axis represents transmittance of the liquid crystal layer 2202. Intensity of light emitted from the display element 220 depends on the transmittance of the liquid crystal layer 2202. When the applied voltage is 0 [V], the transmittance of the liquid crystal layer 2202 is approximately 0%, and the liquid crystal layer 2202 is in an OFF state. As the applied voltage increases, the transmittance will increase gradually, and when the applied voltage exceeds a threshold voltage $V_{th}$, the transmittance will increase rapidly. The transmittance is saturated at a saturation voltage $V_w$. This saturation voltage $V_w$ is a white-level voltage. The display element 220 makes a display, for example, using the transmittance between 0 [V] and the saturation voltage $V_w$.

Returning to FIG. 9, the light including the P-polarized light and the S-polarized light emitted from the display element 220 is incident in the polarization separator 212. The S-polarized light is reflected by the polarization separating plane, and the P-polarized light passes through the polarization separating plane. The P-polarized light that passes through the polarization separating plane is emitted from the polarization separator 212, is incident into the projection optical system 213, and is emitted from the projection apparatus 100*b* as projection light. The projection light emitted from the projection apparatus 100*b* is projected on a projection target medium 102, and the projection video is displayed on the projection target medium 102.

Figure 12:
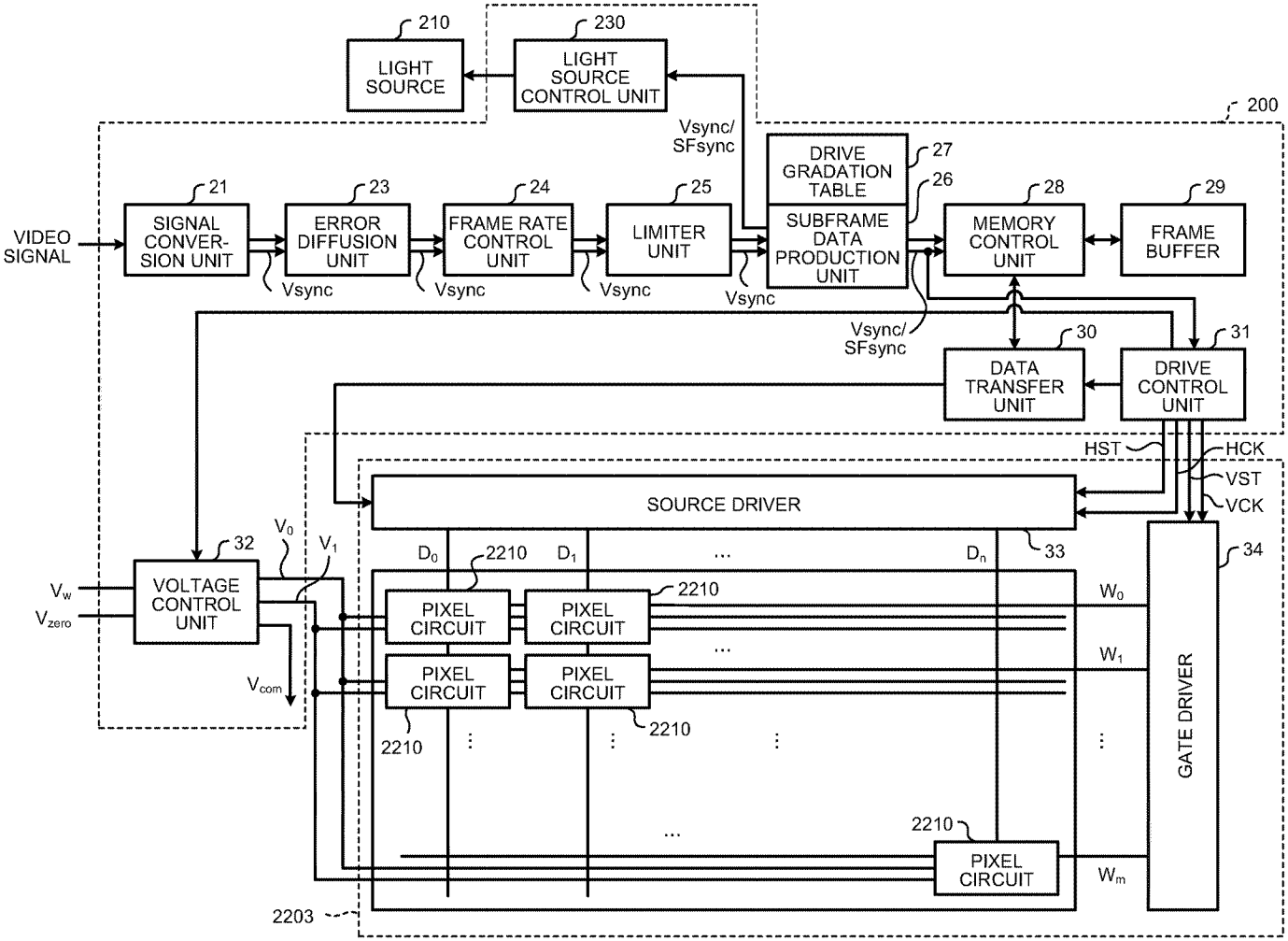
FIG. 12 is a block diagram illustrating an example of a configuration of a video processing and drive unit and a pixel electrode unit according to the second embodiment.

FIG. 12 illustrates an example of a configuration of the video processing and drive unit 200 and the pixel electrode unit 2203 included in the projection apparatus 100*b* according to the second embodiment. In a similar manner to the aforementioned projection apparatus 100*a* according to the first embodiment, a digital drive scheme is applied to this projection apparatus 100*b* according to the second embodiment. The digital drive scheme refers to dividing a frame period of the video signal to produce divided periods, that is, subframes SF, and controlling each pixel of the video signal to an ON state in the number of subframes SF according to a gradation value of the pixel to represent gradation.

In a similar manner to the aforementioned first embodiment, it is assumed below that the gradation is represented by 10-level gradation of the gradation value "0" to "9", that the frame period is equally divided into 12 divided periods including a black transition period in the display element 220, and that 12 subframes SF1 to SF12 are produced.

In FIG. 12, the video processing and drive unit 200 includes a signal conversion unit 21, an error diffusion unit 23, a frame rate control unit 24, a limiter unit 25, a subframe data production unit 26, a drive gradation table 27, a memory control unit 28, a frame buffer 29, a data transfer unit 30, a drive control unit 31, a voltage control unit 32, and a light source control unit 230.

The pixel electrode unit 2203 includes a source driver 33, a gate driver 34, and respective pixel circuits 2210. Here, the source driver 33 and the gate driver 34 may be provided outside of the pixel electrode unit 2203.

In the pixel electrode unit 2203, pixel circuits 2210 are arranged in a matrix, are connected to column data lines $D_0$, $D_1$, . . . , $D_n$ in a column direction, respectively, and are connected to row selection lines $W_0$, $W_1$, . . . , $W_m$ in a row direction, respectively. Each of the column data lines $D_0$, $D_1$, . . . , $D_n$ is connected to the source driver 33. Each of the row selection lines $W_0$, $W_1$, . . . , $W_m$ is connected to the gate driver 34.

The memory control unit 28 is supplied with a frame synchronization signal Vsync and a subframe synchronization signal SFsync from the subframe data production unit 26 described later. In addition, the memory control unit 28 stores subframe data (to be described later) of each subframe SF produced by the subframe data production unit 26 in the frame buffer 29 divided for each subframe SF in response to the subframe synchronization signal SFsync. The frame buffer 29 has double-buffer structure including a first frame buffer and a second frame buffer. The memory control unit 28 can read the subframe data from the first frame buffer while storing video signal data in the second frame buffer.

The drive control unit 31 is supplied with the frame synchronization signal Vsync and the subframe synchronization signal SFsync from the subframe data production unit 26. The drive control unit 31 controls timing of processing for each subframe SF and the like. In accordance with these synchronization signals, the drive control unit 31 provides transmission commands to the data transfer unit 30, and controls the source driver 33 and gate driver 34. More specifically, in accordance with the frame synchronization signal Vsync and the subframe synchronization signal SFsync, the drive control unit 31 generates a vertical start signal VST, a vertical shift clock signal VCK, a horizontal start signal HST, and a horizontal shift clock signal HCK.

The vertical start signal VST and the horizontal start signal HST specify front timing of the subframe SF, and front timing of the line, respectively. The vertical shift clock signal VCK specifies the row selection lines $W_0$, $W_1$, . . . , $W_m$. Meanwhile, the horizontal shift clock signal HCK performs specification corresponding to the column data lines $D_0, D_1, \ldots, D_n$. The vertical start signal VST and the vertical shift clock signal VCK are supplied to the gate driver 34. The horizontal start signal HST and the horizontal shift clock signal HCK are supplied to the source driver 33.

In accordance with control by the drive control unit 31, the data transfer unit 30 commands the memory control unit 28 to read the subframe data of the specified subframe SF from the frame buffer 29. The data transfer unit 30 receives, from the memory control unit 28, the subframe data read from the frame buffer 29, and transfers the received subframe data to the source driver 33 in accordance with control by the drive control unit 31, for example, on a line-by-line basis.

Every time the source driver 33 receives the subframe data of one line from the data transfer unit 30, the source driver 33 transfers the subframe data to the corresponding pixel circuits 2210 simultaneously using the column data lines $D_0, D_1, \ldots, D_n$. The gate driver 34 activates the row selection line of the row specified by the vertical start signal VST and vertical shift clock signal VCK supplied from the drive control unit 31 among the row selection lines $W_0, W_1, \ldots, W_m$. This allows transfer of the subframe data of each pixel to each of the pixel circuits 2210 of all the columns of the specified row.

Furthermore, the drive control unit 31 generates a voltage timing signal based on the frame synchronization signal Vsync and the subframe synchronization signal SFsync. The voltage timing signal is supplied to the voltage control unit 32. In addition, a zero voltage $V_{zero}$ with a voltage value of 0 V and the saturation voltage $V_w$ are supplied to the voltage control unit 32. With timing indicated by the voltage timing signal, the voltage control unit 32 supplies voltages based on the zero voltage $V_{zero}$ and saturation voltage $V_w$ to respective pixel circuits 2210 as a voltage $V_0$, which is a blanking voltage, and a voltage $V_1$, which is a drive voltage. In addition, the voltage control unit 32 outputs a common voltage $V_{com}$ to be supplied to the counter electrode 2201. Here, the blanking voltage and the drive voltage correspond to a voltage for controlling a pixel to an OFF state and a voltage for controlling a pixel to an ON state, respectively.

Figure 13:
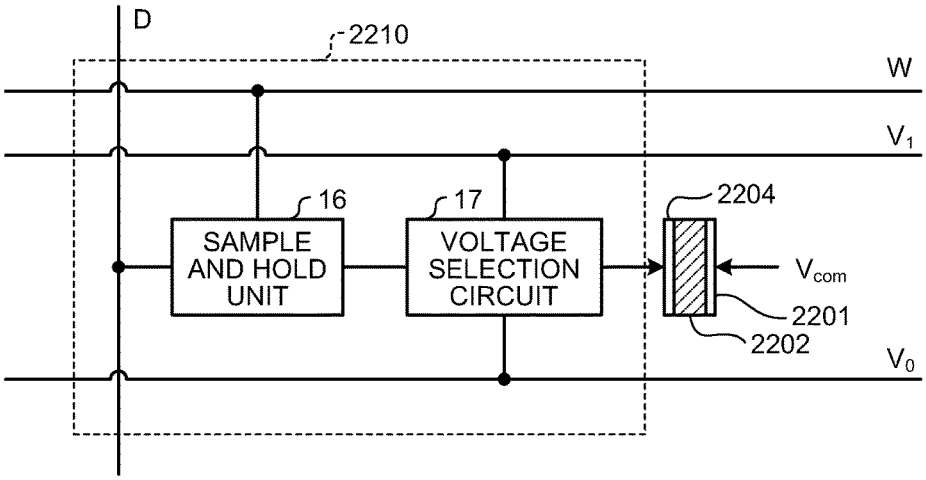
FIG. 13 is a block diagram illustrating a configuration of an example of a pixel circuit according to the second embodiment.

FIG. 13 illustrates a configuration of an example of each of the pixel circuits 2210 according to the second embodiment. The pixel circuit 2210 includes a sample and hold unit 16 and a voltage selection circuit 17, and an output of the voltage selection circuit 17 is supplied to a pixel electrode 2204. Here, the counter electrode 2201 facing the pixel electrode 2204 with the inserted liquid crystal layer 2202 is supplied with the common voltage $V_{com}$. The sample and hold unit 16 is configured using a flip-flop of SRAM (Static Random Access Memory) structure. Signals are input from the column data line D and the row selection line W to the sample and hold unit 16, and an output of the sample and hold unit 16 is supplied to the voltage selection circuit 17. The voltage selection circuit 17 is supplied with the voltage $V_0$ and the voltage $V_1$ from the voltage control unit 32.

Next, an operation of the video processing and drive unit 200 will be described. The digital video signal is supplied to the signal conversion unit 21. The signal conversion unit 21 both extracts the frame synchronization signal Vsync from the supplied video signal, and converts the video signal into video signal data in a predetermined number of bits for output. The signal conversion unit 21 supplies the extracted frame synchronization signal Vsync to the error diffusion unit 23, the frame rate control unit 24, the limiter unit 25, and the subframe data production unit 26, respectively.

In addition, the video signal data that is output from the signal conversion unit 21 undergoes predetermined signal processing by the error diffusion unit 23, the frame rate control unit 24, and the limiter unit 25, and is then supplied to the subframe data production unit 26.

Figure 14:
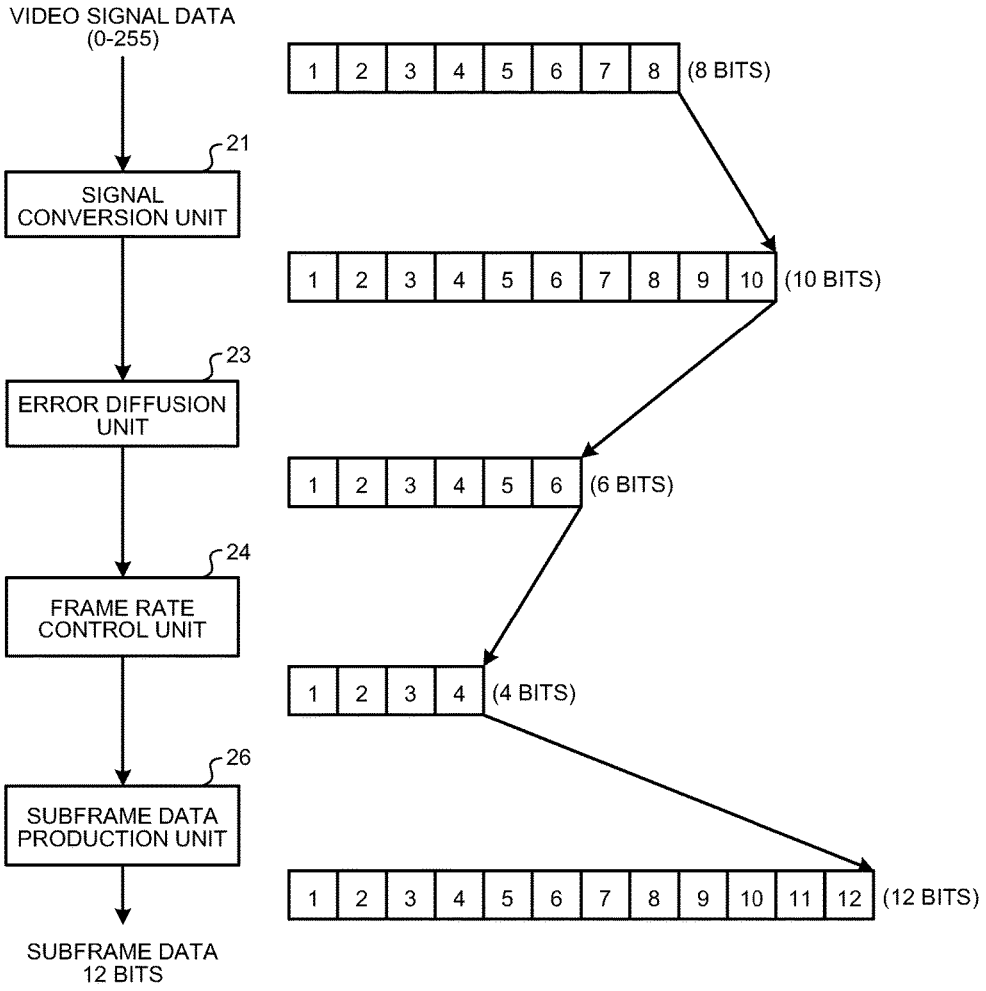
FIG. 14 is a diagram for describing a flow of processing in a signal conversion unit, an error diffusion unit, a frame rate control unit, and a subframe data production unit according to the second embodiment.

With reference to FIG. 14, a flow of processing will be described in the signal conversion unit 21, the error diffusion unit 23, the frame rate control unit 24, and the subframe data production unit 26 according to the second embodiment. The description here assumes that the video signal to be input into the signal conversion unit 21 is 8-bit video signal data.

The signal conversion unit 21 converts the input N-bit video signal data into (M+F+D)-bit data having a larger number of bits. Here, a value M represents the number of bits corresponding to the number of subframes SF represented in binary, a value D represents the number of bits to be required for interpolation by the error diffusion unit 23, and a value F represents the number of bits to be required for interpolation by the frame rate control unit 24. Here, each of the value N, value M, value F, and value D is an integer equal to or greater than 1. In the example of FIG. 14, the value N=8, value D=4, value F=2, and value M=4.

The signal conversion unit 21 performs bit number conversion processing, for example, using a look-up table. In general, as described above, a display has input-output characteristics according to a gamma curve of a gamma value $\gamma=2.2$. Therefore, the video signal that is output from the video output apparatus 101 is a signal corrected by the gamma curve according to the gamma value of reciprocal of the gamma value of the display so as to obtain linear gradation representation when displayed on the display.

The signal conversion unit 21 converts the input video signal data by using the look-up table adjusted in advance so as to bring the input-output characteristics of the projection unit 240 close to standard characteristics, that is, the characteristics of the gamma curve of the gamma value $\gamma=2.2$. This conversion processing is referred to as calibration. At this time, using the look-up table, the signal conversion unit 21 converts the N-bit video signal data into the (M+F+D)-bit video signal data for output. In this example where the value N=8, value D=4, value F=2, and value M=4, the signal conversion unit 21 converts 8-bit video signal data into 10-bit video signal data for output.

The video signal data converted into (M+F+D) bits by the signal conversion unit 21 is converted into (M+F)-bit data by the error diffusion unit 23 diffusing lower-D-bit information into nearby pixels. In this example where the value N=8, value D=4, value F=2, and value M=4, the error diffusion unit 23 diffuses lower-4-bit information of the 10-bit video signal data of each pixel that is output from the signal conversion unit 21 into nearby pixels, and quantizes the 10-bit video signal data into upper-6-bit data.

An error diffusion method is a method for compensating shortage of gradation by diffusing an error (display error) between the video signal to be displayed and an actually displayed value into nearby pixels. According to the second embodiment, lower 4 bits of the video signal to be displayed are defined as a display error, 7/16 of the display error is added to a pixel right neighbor to the noted pixel, 3/16 of the display error is added to a lower left pixel, 5/16 of the display error is added to a pixel directly under the noted pixel, and 1/16 of the display error is added to a lower right pixel. This processing is performed on each pixel, for example, from left to right within one frame of video, and this processing is performed on each line from top to bottom within one frame of video.

An operation of the error diffusion unit 23 will be described in more detail. While the noted pixel diffuses the error as described above, the error diffused by an immediately preceding noted pixel is added to the noted pixel. The error diffusion unit 23 first reads, from an error buffer, the error diffused from the immediately preceding noted pixel, and adds the read error to the noted pixel of the input 10-bit video signal data. The error diffusion unit 23 divides the 10-bit noted pixel to which a value of the error buffer is added into upper 6 bits and lower 4 bits.

A value of the divided lower four bits, which is denoted as (lower four bits, display error), is as follows.

(0000, 0)
(0001, +1)
(0010, +2)
(0011, +3)
(0100, +4)
(0101, +5)
(0110, +6)
(0111, +7)
(1000, −7)
(1001, −6)
(1010, −5)
(1011, −4)
(1100, −3)
(1101, −2)
(1110, −1)
(1111, 0)

The display error corresponding to the value of the divided lower 4 bits is added to the error buffer for storage. In addition, the value of the divided lower 4 bits is compared with a threshold, and when the value is larger than "1000" in binary notation, "1" is added to the value of the upper 6 bits. Then, upper 6-bit data is output from the error diffusion unit 23.

The video signal data converted into (M+F) bits by the error diffusion unit 23 is input into the frame rate control unit 24. The frame rate control unit 24 performs frame control processing for displaying a pseudo gradation, by setting p frames (p is an integer equal to or greater than 2) for one-pixel display of the display element 220 as one period, performing ON display in q frames (q is an integer of p>q>0) of the period, and performing OFF display in remaining (p-q) frames.

In other words, the frame rate control processing is processing for making a pseudo intermediate gradation by using rewriting of a screen and an afterimage effect of a retina. For example, by rewriting a certain pixel alternately with a gradation value "0" and a gradation value "1" for each frame, the pixel appears to have a gradation value intermediate between the gradation value "0" and the gradation value "1" to human eyes. Then, control of such alternate rewriting of the gradation value "0" and the gradation value "1", for example, for four frames as one set, enables pseudo representation of three-level gradation between the gradation value "0" and gradation value "1".

Figure 15:
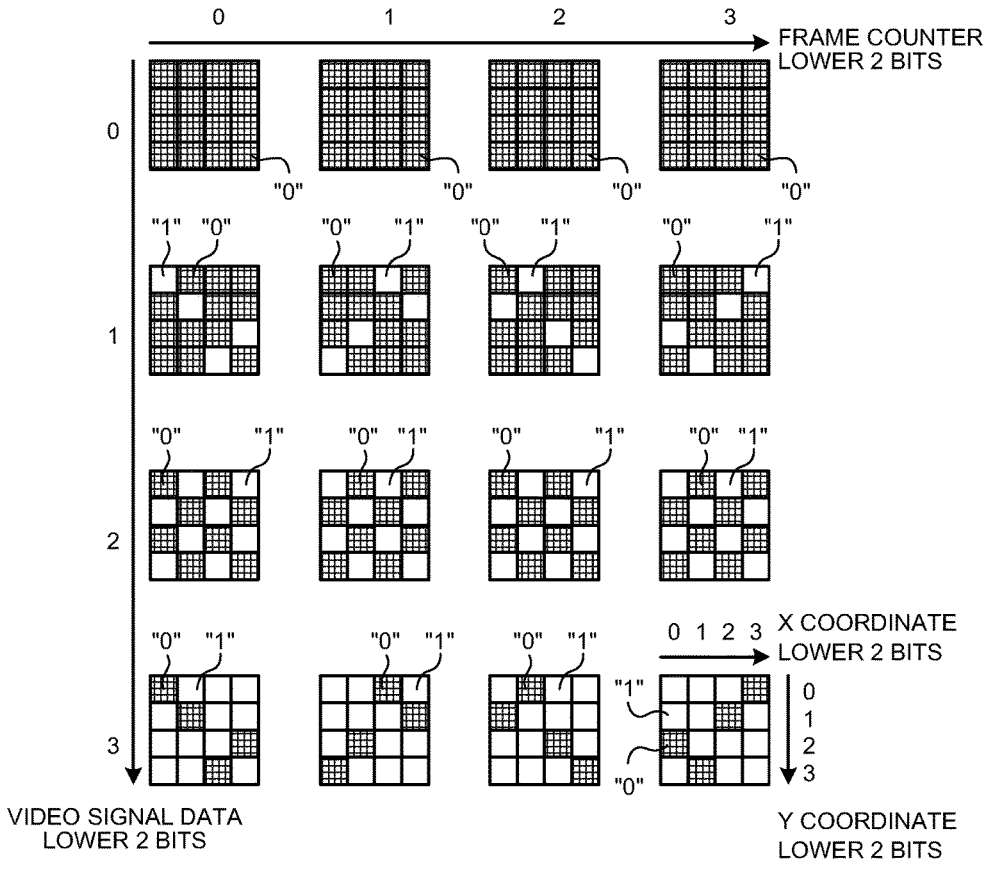
FIG. 15 is a diagram illustrating an example of a frame rate control table according to the second embodiment.

The frame rate control unit 24 includes a frame rate control table illustrated in FIG. 15. The frame rate control unit 24 further includes a frame counter that counts frames, for example, based on the frame synchronization signal Vsync. In the example of FIG. 15, in the frame rate control table, four-by-four matrices (referred to as small matrices) in which a value "0" or "1" is specified in each cell are further arranged in a four-by-four matrix (referred to as a large matrix). In FIG. 15, the cell of a value "0" is shaded, and the cell of a value "1" is illustrated in white.

Each column of the large matrix is specified by a lower 2-bit value in a counter value of the frame counter. Each row of the large matrix is specified by a lower 2-bit value in the 6-bit video signal data that is input into the frame rate control unit 24. Each column and each row of each small matrix are specified based on positional information of a pixel within a display area, that is, coordinates of the pixel. More specifically, each column of each small matrix is specified by a lower 2-bit value of an X coordinate of the pixel, and each row is specified by a lower 2-bit value of a Y coordinate of the pixel.

The frame rate control unit 24 specifies a position within the frame rate control table from a lower F-bit value of supplied (M+F)-bit video signal data, positional information on the pixel, and frame count information. The frame rate control unit 24 then adds a value (value "0" or value "1") at the position to upper M bits. Thereby (M+F)-bit video signal data is converted into M-bit data.

In this example where the value F=2 and value M=4, the 6-bit video signal data that is output from the error diffusion unit 23 is input into the frame rate control unit 24. The frame rate control unit 24 acquires the value "0" or value "1" from the frame rate control table, based on the lower 2-bit information of this video signal data, positional information in the display area, and frame counter information. The frame rate control unit 24 then adds the acquired value to an upper 4-bit value separated from 6 bits of the input video signal data.

More specifically, the frame rate control unit 24 divides the input six-bit video signal data (pixel data) into upper 4-bit data and lower 2-bit data. The frame rate control unit 24 specifies a position in the large matrix and small matrix of the frame rate control table of FIG. 15, by using a value of a total of 8 bits including the lower 2-bit data obtained by bit-separation, lower 2 bits of the X coordinate and lower 2 bits of the Y coordinate of the pixel in the display area, as well as lower 2 bits of the counter value of the frame counter. The frame rate control unit 24 then acquires the value "0" or value "1" specified by the specified position. The frame rate control unit 24 adds the acquired value "0" or value "1" to upper 4-bit data separated from the input video signal data, and outputs the data as 4-bit video signal data.

Thus, the frame rate control unit 24 controls on/off of the pixel for each gradation on a pixel block basis. This enables further representation of pseudo gradation between two continuous gradations.

With reference to FIG. 12, the 4-bit video signal data that is output from the frame rate control unit 24 is supplied to the limiter unit 25. The limiter unit 25 limits the maximum value of the gradation value of the supplied video signal data to "9". The video signal data with the maximum value of the gradation value limited to "9" by the limiter unit 25 is supplied to the subframe data production unit 26. The subframe data production unit 26 converts the supplied video signal data into 12-bit data by using the drive gradation table 27.

In addition, the subframe data production unit 26 generates the subframe synchronization signal SFsync based on the supplied frame synchronization signal Vsync. The subframe data production unit 26 supplies the frame synchronization signal Vsync and the subframe synchronization signal SFsync to the memory control unit 28 and the drive control unit 31, and to the light source control unit 230.

FIG. 16 illustrates an example of the drive gradation table 27 applicable to the second embodiment. In FIG. 16, in a similar manner to the aforementioned FIG. 6, each column is the subframe SF1, SF2, . . . , SF12 from left to right.

Among these subframes, the subframe SF1 is a subframe including the front end of the frame period, and the subframe SF12 is a subframe including the rear end of the frame period. In FIG. 16, the gradation value increases by 1 from 0 in each row from top to bottom. The gradation value "0" is the lowest (darkest) gradation, and the gradation value "9" is the highest (brightest) gradation.

According to the second embodiment, contrary to the example of the first embodiment described with reference to FIG. 6, the number of subframes according to the gradation value of the pixel is selected sequentially from the rear end of the frame period, and in the selected subframes, the pixel is controlled to an ON state. In FIG. 16, a hatched cell of the value "1" represents controlling the pixel to an ON state, while a cell of the value "0" represents controlling the pixel to an OFF state. Thus, the drive gradation table 27 stores the values that represent on/off control of the pixel in association with the subframes SF1 to SF12 and the gradation values.

According to the second embodiment, the drive gradation table 27 stores the value "0" that represents OFF control of the pixel in association with respective gradation values of the subframes SF1 to SF3.

Thus, according to the second embodiment, in a similar manner to the aforementioned first embodiment, the subframes for performing ON and OFF control are allocated in advance for each gradation.

With reference to the drive gradation table 27 in accordance with the video signal data, the subframe data production unit 26 converts data of each pixel into data of a value "0" or value "1" (hereinafter referred to as 0/1 data) for each subframe SF, and produces the subframe data.

For example, with reference to the aforementioned FIG. 7B, in the subframes SF1 to SF3, the pixels of coordinates $(x_0, y_0)$ to $(x_4, y_0)$ with the gradation values "3", "1", "0", "5", and "9" are respectively converted into 0/1 data of the value "0", "0", "0", "0", and "0", and become subframe data of the subframes SF1 to SF3. The pixels are respectively converted into 0/1 data of the values "0", "0", "0", "0", and "1" in the subframe SF4, and become subframe data of the subframe SF4. The pixels are respectively converted into 0/1 data of the values "1", "1", "0", "1", and "1" in the subframe SF12, and become subframe data of the subframe SF12.

Figure 17:
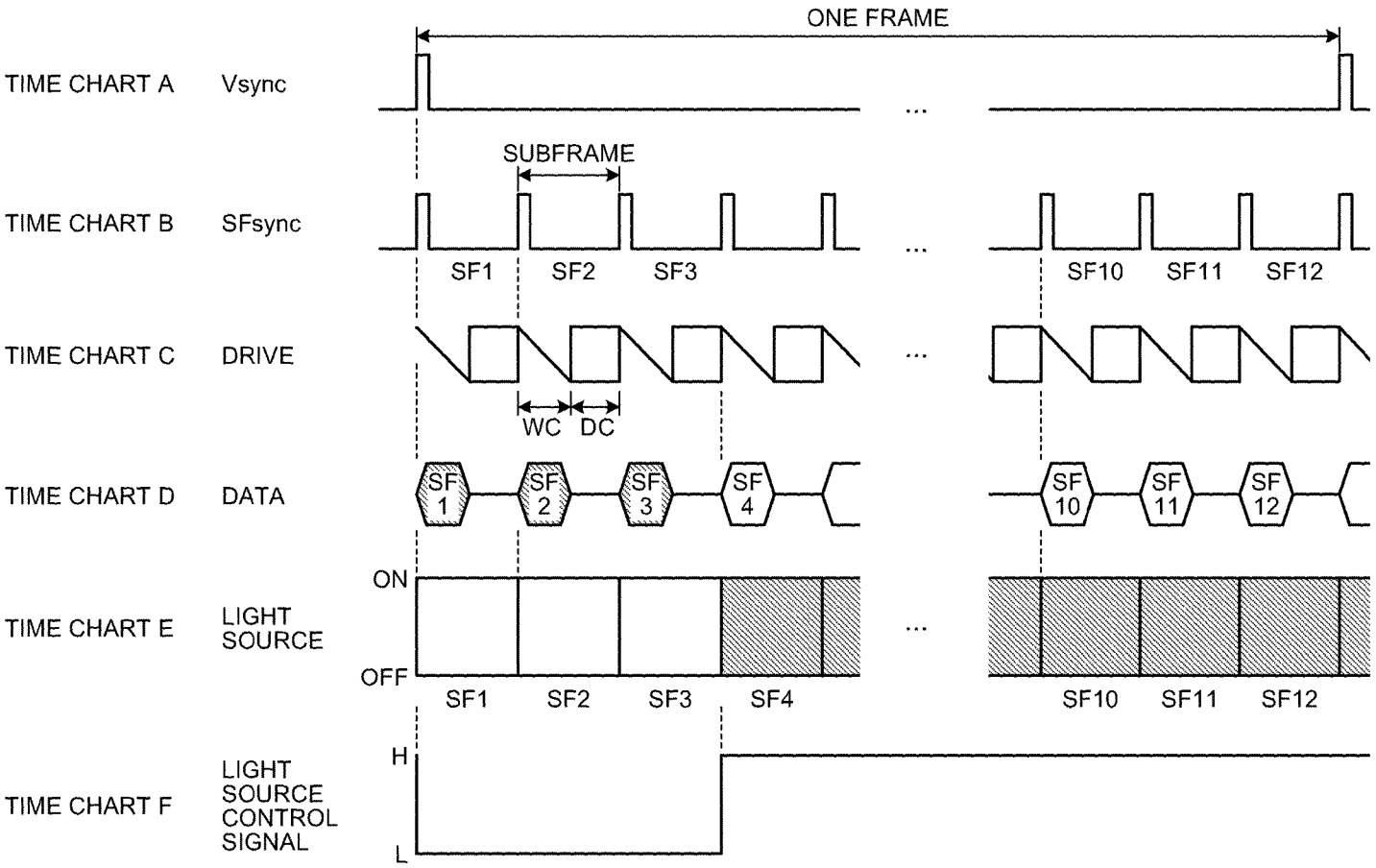
FIG. 17 is a time chart illustrating an example of control according to the second embodiment.

FIG. 17 is a time chart illustrating an example of control according to the second embodiment. The time chart of FIG. 17 corresponds to the aforementioned time charts of FIG. 3, and include driving timing regarding the display element 220, driving timing of the light source 210, and the light source control signal. TIME CHART A in FIG. 17 and TIME CHART B in FIG. 17 illustrate examples of the frame synchronization signal Vsync and the subframe synchronization signal SFsync, respectively. The example of TIME CHART B in FIG. 17 corresponds to the aforementioned FIG. 16, and the one-frame period is divided into 12 subframes SF1 to SF12.

TIME CHART C in FIG. 17 illustrates an example of driving timing of the display element 220, and TIME CHART D in FIG. 17 illustrates an example of transfer timing of the video signal data to the pixel electrode unit 2203. In addition, TIME CHART E in FIG. 17 illustrates an example of control of the light source 210, and TIME CHART F in FIG. 17 illustrates an example of the light source control signal for controlling the light source 210.

In TIME CHART C in FIG. 17, a period WC represents a data transfer period for transferring video signal data of each subframe SF to all the pixel circuits 2210 included in the pixel electrode unit 2203. A period DC represents a driving period for driving the pixel circuits 2210. The period WC and period DC are disposed in one subframe SF. The period WC starts with start timing of the subframe SF, and after completion of the period WC, the period DC starts. The period DC ends with completion timing of the subframe SF.

According to the second embodiment, the subframe data of the subframes SF1 to SF3 illustrated by hatching in TIME CHART D in FIG. 17 is data of a value "0" for all the pixel circuits 2210 included in the pixel electrode unit 2203.

With reference to FIG. 12 and FIG. 13, within the one-frame period, in order of subframes SF1, SF2, . . . , SF11, SF12 from the front in a time base direction, subframe data of each subframe SF1, SF2, . . . , SF11, SF12 is read from the frame buffer 29, and is transferred to each pixel circuit 2210 in the period WC. The transferred subframe data is held in the sample and hold unit 16 of each pixel circuit 2210.

As an example, the data transfer unit 30 transfers the subframe data to the source driver 33 on a line-by-line basis in accordance with control by the drive control unit 31. In accordance with control by the drive control unit 31, the source driver 33 writes the transferred subframe data, for example, in registers respectively corresponding to the data lines $D_0, D_1, \ldots, D_n$ for each pixel for holding. Here, the data to be held for each pixel is 0/1 data of a value "0" or value "1" obtained through conversion of the pixel gradation value in accordance with the drive gradation table 27.

In addition, in accordance with control by the drive control unit 31, the gate driver 34 sequentially selects the row selection lines $W_0, W_1, \ldots, W_m$, with transfer timing of the subframe data on a line-by-line basis. This causes the sample and hold unit 16 of each pixel circuit 2210 selected by the row selection lines $W_0, W_1, \ldots, W_m$ to acquire and hold 0/1 data of each pixel held in the source driver 33. This causes the sample and hold units 16 of all the pixel circuits 2210 included in the pixel electrode unit 2203 to hold 0/1 data of the pixels in the period WC, respectively.

In the period DC, all the pixel circuits 2210 included in the pixel electrode unit 2203 are driven. With reference to FIG. 13, drive control of the pixel circuits 2210 will be described. In the period WC in which 0/1 data is transferred to each pixel circuit 2210, it is necessary to make the pixel in a blanking state regardless of the value of 0/1 data held in the sample and hold unit 16. Therefore, in accordance with control by the drive control unit 31, the voltage control unit 32 sets the voltage $V_0$, voltage $V_1$, and common voltage $V_{com}$ as identical potential (for example, earth potential) in the period WC.

After the period WC ends, the period DC, which is the driving period, starts. In accordance with control by the drive control unit 31, the voltage control unit 32 drives each pixel circuit 2210 in each of a period DC #1 and DC #2 obtained through equal division of the period DC. In the period DC #1, the voltage control unit 32 sets the voltage $V_1$ to the saturation voltage $V_w$, and sets the voltage $V_0$ and common voltage $V_{com}$ to earth potential. In the period DC #2, contrary to the period DC #1, the voltage control unit 32 sets the voltage $V_1$ to earth potential, and sets the voltage $V_0$ and common voltage $V_{com}$ to the saturation voltage $V_w$.

In the pixel circuit 2210, when 0/1 data held in the sample and hold unit 16 is a value "0", the voltage selection circuit 17 selects the voltage $V_0$ as the voltage to be applied to the pixel electrode 2204. In the period DC #1, a voltage Vpe of the pixel electrode 2204 and the common voltage $V_{com}$ to be applied to the counter electrode 2201 are earth potential. Therefore, the voltage to be applied to the liquid crystal layer 2202 becomes 0 [V], and a drive state of the liquid crystal layer 2202 becomes in a blanking state (OFF state).

In the pixel circuit 2210, when 0/1 data held in the sample and hold unit 16 is a value "1", the voltage selection circuit 17 selects the voltage $V_1$ as the voltage to be applied to the pixel electrode 2204. In the period DC #1, the voltage Vpe of the pixel electrode 2204 becomes the saturation voltage $V_w$, and the common voltage $V_{com}$ to be applied to the opposite electrode 2201 becomes earth potential. Therefore, the voltage to be applied to the liquid crystal layer 2202 becomes the positive saturation voltage $V_w$ with respect to potential of the counter electrode 2201, and the liquid crystal layer 2202 becomes in a drive state (ON state). In addition, in the period DC #2, the voltage Vpe of the pixel electrode 2204 becomes earth potential, and the common voltage $V_{com}$ to be applied to the counter electrode 2201 becomes the saturation voltage $V_w$ (saturation voltage+$V_w$). The voltage to be applied to the liquid crystal layer 2202 becomes the negative saturation voltage $V_w$ (saturation voltage−$V_w$) with respect to potential of the counter electrode 2201, and the liquid crystal layer 2202 becomes in a drive state (ON state).

By applying the voltages with an identical absolute value and different polarity (saturation voltage +$V_w$ and −$V_w$) to the liquid crystal layer 2202 for an identical period, the voltage applied to the liquid crystal layer 2202 becomes 0 [V] on average for a long time, which may prevent burn-in of the liquid crystal.

Returning to description of FIG. 17, TIME-CHART E in FIG. 17 illustrates an example of control of the light source 210 performed by the light source control unit 230. As described with reference to FIG. 16, according to the second embodiment, the gradation values of gradation of the subframes SF1 to SF3 are all "0". Accordingly, the light source control unit 230 controls the light source 210 to stop light emission in the subframes SF1 to SF3, and to emit light in the subframes SF4 to SF12 other than the subframes SF1 to SF3.

As an example, it is assumed that the light source 210 emits light in a high (H) state of the light source control signal, and that the light source 210 stops light emission in a low (L) state. In this case, in accordance with the frame synchronization signal Vsync and subframe synchronization signal SFsync supplied from the subframe data production unit 26, as illustrated in TIME-CHART F in FIG. 17, the light source control unit 230 generates the light source control signal that is in a low state in the period of the subframes SF1 to SF3, and that is in a high state in the period of the subframes SF4 to SF12, and then the light source control unit 230 supplies the light source control signal to the light source 210.

Thus, even light emission of the light source 210 is stopped in the predetermined period including the front end of the frame period, in a similar manner to the aforementioned first embodiment, a temporal section is masked including the black transition period in which control of the pixel is switched from an ON state to an OFF state, for example, due to transition from the subframe SF12 of the immediately preceding frame period to the current subframe SF1. This may provide black display more securely in the black transition period, and may improve display quality of a moving image.

The present invention produces an effect of enabling improvement in display quality of a moving image made by a liquid crystal display element.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method comprising:

dividing one-frame period of a video signal into a plurality of subframes;

converting an input N-bit video signal data into (M+F+D)-bit data having a larger number of bits:

diffusing lower-D-bit information of the (M+F+D)-bit data into nearby pixels to convert the (M+F+D)-bit-data into (M+F)-bit-data;

specifying a position within a frame rate control table from a lower F-bit value of the (M+F)-bit data, positional information on a pixel, and frame count information, and add a value at the position to upper M bits to convert the (M+F)-bit data into M-bit data;

converting data of each of the pixels into data of a value "0" or value "1" for each subframe to produce subframe data based on the M-bit data;

setting each of the pixels to OFF in a predetermined first period including at least one of a front end and a rear end of a frame period of the video signal;

irradiating, simultaneously, the pixels with light; and stopping light emission of a light source on a display element in a second period including the first period, wherein the first period is shorter than the frame period, a value M represents the number of bits corresponding to the number of subframes represented in binary, a value D represents the number of bits to be required for interpolation, and a value F represents the number of bits to be required for interpolation.

2. The method according to claim 1, wherein, based on subframe data, controlling each of the pixels to ON in the consecutive subframes from the end of the frame period not included in the first period, which does not include the first period and the number of which corresponds to the gradation of each of the pixels.

3. A method for driving a display apparatus including a display element that includes a plurality of pixels, each of which includes a sample and hold unit, the method comprising:

dividing one-frame period of a video signal into a plurality of subframes;

converting an input N-bit video signal data into (M+F+D)-bit data having a larger number of bits:

diffusing lower-D-bit information of the (M+F+D)-bit data into nearby pixels to convert the (M+F+D)-bit-data into (M+F)-bit-data;

specifying a position within a frame rate control table from a lower F-bit value of the (M+F)-bit data, positional information on a pixel, and frame count information, and add a value at the position to upper M bits to convert the (M+F)-bit data into M-bit data;

converting data of each of the pixels into data of a value "0" or value "1" for each subframe to produce subframe data based on the M-bit data;

controlling each of the pixels to OFF in a predetermined first period including at least one of a front end and a rear end of a one-frame period of the video signal; and stopping light emission of a single light source that is configured to simultaneously irradiate the pixels with light on the display element in a second period including the first period, wherein the first period is shorter than the frame period, a value M represents the number of bits corresponding to the number of subframes represented in binary, a value D represents the number of bits to be required for interpolation, and a value F represents the number of bits to be required for interpolation.

4. The according to claim 1, wherein each of the subframes includes a data transfer period for transferring subframe data and a driving period for simultaneously driving all the pixels included in the display element according to the subframe data of each of the pixels, and controlling each of the pixels to OFF both in the first period and in the data transfer period.

* * * * *